US011048285B2

(12) United States Patent
Chien

(10) Patent No.: US 11,048,285 B2
(45) Date of Patent: Jun. 29, 2021

(54) REFERENCE VOLTAGE GENERATION CIRCUIT

(71) Applicant: RichWave Technology Corp., Taipei (TW)

(72) Inventor: Hwey-Ching Chien, Taipei (TW)

(73) Assignee: RichWave Technology Corp., Taipei (TW)

( * ) Notice: Subject to any disclaimer, the term of this patent is extended or adjusted under 35 U.S.C. 154(b) by 0 days.

(21) Appl. No.: 16/903,365

(22) Filed: Jun. 16, 2020

(65) Prior Publication Data

US 2021/0034091 A1 Feb. 4, 2021

(30) Foreign Application Priority Data

Jul. 30, 2019 (TW) ..... 108126910

(51) Int. Cl.
*G05F 3/22* (2006.01)
*G05F 1/46* (2006.01)
*G05F 3/30* (2006.01)

(52) U.S. Cl.
CPC ..... *G05F 3/22* (2013.01); *G05F 1/468* (2013.01); *G05F 3/30* (2013.01)

(58) Field of Classification Search
None
See application file for complete search history.

(56) References Cited

U.S. PATENT DOCUMENTS 7,098,729 B2 * 8/2006 Abe ..... G05F 3/30 323/313
10,437,274 B2 * 10/2019 Chien ..... G05F 3/222
10,739,801 B2 * 8/2020 Tang ..... G05F 1/575

FOREIGN PATENT DOCUMENTS

TW 201504786 A 2/2015
TW 201506572 A 2/2015
TW 201525647 A 7/2015
TW 201621509 A 6/2016
TW 201827974 A 8/2018

* cited by examiner

*Primary Examiner* — Jeffery S Zweizig
(74) *Attorney, Agent, or Firm* — Winston Hsu

(57) ABSTRACT

A reference voltage generation circuit includes a supply voltage terminal, a node, a current source, an output terminal, a common voltage terminal, a bandgap reference circuit and a feedback circuit. The supply voltage terminal is used to provide a supply voltage. The current source is coupled between the supply voltage terminal and the node, and used to receive the supply voltage and generate a current according to a feedback signal, and output the current to establish at the node a first voltage substantially insensitive to the supply voltage. The common voltage terminal is used to provide a common voltage. The bandgap reference circuit is coupled between the node and the common voltage terminal, and used to establish a temperature-invariant bandgap voltage at the output terminal. The feedback circuit is coupled to the node and the current source, and used to generate the feedback signal according to the first voltage.

15 Claims, 2 Drawing Sheets

REFERENCE VOLTAGE GENERATION CIRCUIT

CROSS REFERENCE TO RELATED APPLICATION

This non-provisional application claims priority of Taiwan patent application No. 108126910, filed on 30 Jul. 2019, included herein by reference in its entirety.

TECHNICAL FIELD

The invention relates to a reference voltage generation circuit, and specifically, to a reference voltage generation circuit insensitive to temperature variations and voltage variations.

BACKGROUND

A reference voltage generation circuit, and in particular a bandgap voltage generation circuit may provide a reference voltage level insensitive to temperature variations. However, when a supply voltage to the reference voltage generation circuit shifts, the reference voltage level will shift accordingly, resulting in being unable to deliver a stable reference voltage.

Thus, a reference voltage generation circuit is in need to provide a stable voltage less susceptible to temperature or voltage variations.

SUMMARY

According to one embodiment of the invention, a reference voltage generation circuit for generating a bandgap reference voltage includes a supply voltage terminal, a node, a first current source, an output terminal, a common voltage terminal, a bandgap reference circuit and a feedback circuit. The supply voltage terminal is used to provide a supply voltage. The first current source is coupled between the supply voltage terminal and the node, and used to receive the supply voltage and generate a first current according to a feedback signal, and output the first current to establish at the node a first voltage substantially insensitive to the supply voltage. The common voltage terminal is used to provide a common voltage. The bandgap reference circuit is coupled between the node and the common voltage terminal, and used to establish a temperature-invariant bandgap voltage at the output terminal. The feedback circuit is coupled to the node and the current source, and used to generate a feedback signal according to the first voltage. A variation trend of the first voltage is related to a variation trend of the feedback signal.

According to another embodiment of the invention, a reference voltage generation circuit for generating a bandgap reference voltage includes a supply voltage terminal, a node, a first current source, an output terminal, a common voltage terminal, a bandgap reference circuit and a feedback circuit. The supply voltage terminal is used to provide a supply voltage. The first current source is coupled between the supply voltage terminal and the node, and used to generate a first current according to the supply voltage, and output the first current to establish a first voltage at the node. The common voltage terminal is used to provide a common voltage. The bandgap reference circuit is coupled between the node and the common voltage terminal, and used to establish the bandgap reference voltage at the output terminal, and includes a second current source, a first resistor, a first bipolar junction transistor, a second resistor, a second bipolar junction transistor, a third resistor, a third bipolar junction transistor, and a fourth resistor. The second current source is coupled to the node, and used to generate a second current to establish the bandgap reference voltage at the output terminal. The first resistor has a first terminal and a second terminal. The first terminal of the first resistor is coupled to the output terminal. The first bipolar junction transistor has a collector, a base, and an emitter, wherein the collector of the first bipolar junction transistor is coupled to the second terminal of the first resistor and the base of the first bipolar junction transistor, and the emitter of the first bipolar junction transistor is coupled to the common voltage terminal. The second resistor has a first terminal and a second terminal, and the first terminal of the second resistor is coupled to the output terminal. The second bipolar junction transistor has a collector coupled to the second terminal of the second resistor, a base coupled to the base of the first bipolar junction transistor, and an emitter. The third resistor is coupled between the emitter of the second bipolar junction transistor and the common voltage terminal. The third bipolar junction transistor has a collector, a base coupled to the collector or the base of the second bipolar junction transistor, and an emitter coupled to the common voltage terminal. The fourth resistor has a first terminal and a second terminal. The first terminal of the fourth resistor is coupled to the node, and the second terminal of the fourth resistor is coupled to the second current source and the collector of the third bipolar junction transistor. The feedback circuit is coupled to the node and the first current source, and used to stabilize the first voltage, and includes a fourth bipolar junction transistor and a fifth resistor. The fourth bipolar junction transistor has a collector, a base, and an emitter coupled to the common voltage terminal. A voltage at the base of the fourth bipolar junction transistor is controlled by the first voltage. The fifth resistor has a first terminal coupled to the supply voltage terminal and a second terminal coupled to the first current source and the collector of the fourth bipolar junction transistor.

DETAILED DESCRIPTION

Figure 1:
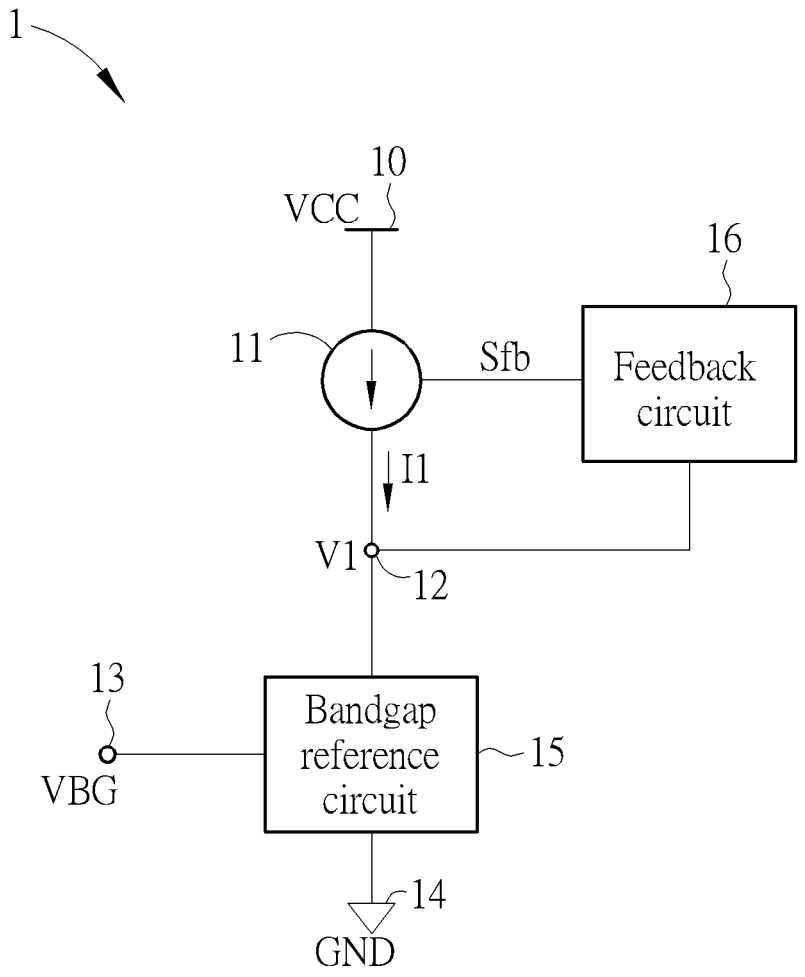
FIG. 1 is a block diagram of a reference voltage generation circuit according to an embodiment of the invention.

Below, exemplary embodiments will be described in detail with reference to accompanying drawings so as to be easily realized by a person having ordinary knowledge in the art. The inventive concept may be embodied in various forms without being limited to the exemplary embodiments set forth herein. Descriptions of well-known parts are omitted for clarity, and like reference numerals refer to like elements throughout.

FIG. 1 is a block diagram of a reference voltage generation circuit 1 according to an embodiment of the invention. The reference voltage generation circuit 1 includes a supply voltage terminal 10, a current source 11, a node 12, an output terminal 13, a common voltage terminal 14, a bandgap reference circuit 15 and a feedback circuit 16. The reference voltage generation circuit 1 may generate a bandgap reference voltage VBG at the output terminal 13. The supply voltage terminal 10 may provide a supply voltage VCC, and the common voltage terminal 14 may provide a common voltage GND. The current source 11 is coupled between the supply voltage terminal 10 and the node 12. The bandgap reference circuit 15 is coupled between the node 12 and the common voltage terminal 14. The feedback circuit 16 is coupled to the node 12 and the current source 11. The reference voltage generation circuit 1 may establish a voltage V1 substantially insensitive to the variations of the supply voltage VCC at the node 12, so as to generate the bandgap reference voltage VBG which is less susceptible to temperature or voltage variations of the supply voltage.

The feedback circuit 16 may receive the voltage V1 from the node 12 and generate a feedback signal Sfb according to the first voltage V1, wherein a variation trend of the first voltage V1 is related to, e.g., in opposite to, a variation trend of the feedback signal Sfb. The current source 11 may receive the supply voltage VCC, generate a current I1 according to the feedback signal Sfb, and, output the current I1 to establish at the node 12 the voltage V1 substantially insensitive to the variations of the supply voltage VCC. The bandgap reference circuit 15 may receive the voltage V1 to establish at the output terminal 13 the bandgap reference voltage VBG substantially insensitive to temperature variations. When the supply voltage VCC increases, the voltage V1 may increase accordingly, and the feedback circuit 16 may decrease the feedback signal Sfb in accordance with the increase of the voltage V1. The current source 11 may reduce the current I1 in accordance with the decreased feedback signal Sfb to establish at the node 12 the voltage V1 substantially insensitive to the variations of the supply voltage VCC. When the supply voltage VCC decreases, the voltage V1 may decrease accordingly, and the feedback circuit 16 may increase the feedback signal Sfb in accordance with the decrease of the voltage V1. The current source 11 may raise the current I1 in accordance with the increased feedback signal Sfb to establish at the node 12 the voltage V1 substantially insensitive to the variations of the supply voltage VCC. Since the voltage V1 may remain unchanged regardless of the supply voltage VCC, the bandgap reference circuit 15 may generate the bandgap reference voltage VBG invariant with variations of the supply voltage VCC. The bandgap reference circuit 15 may be a Widlar bandgap reference circuit as shown in FIG. 2.

In another embodiment, a current source 11 and a feedback circuit 16 having different properties may be selected to increase the voltage V1 with an increase of the supply voltage VCC. The feedback circuit 16 may increase the feedback signal Sfb in accordance with an increase of the voltage V1, and the current source 11 may decrease the current I1 in accordance with the increased feedback signal Sfb, so as to establish at the node 12 the voltage V1 substantially insensitive to the variations of the supply voltage VCC. The voltage V1 may be decreased with a decrease of the supply voltage VCC. The feedback circuit 16 may decrease the feedback signal Sfb in accordance with a decrease of the voltage V1. The current source 11 may raise the current I1 in accordance with the decreased feedback signal Sfb to establish at the node 12 the voltage V1 substantially insensitive to the variations of the supply voltage VCC.

Figure 2:
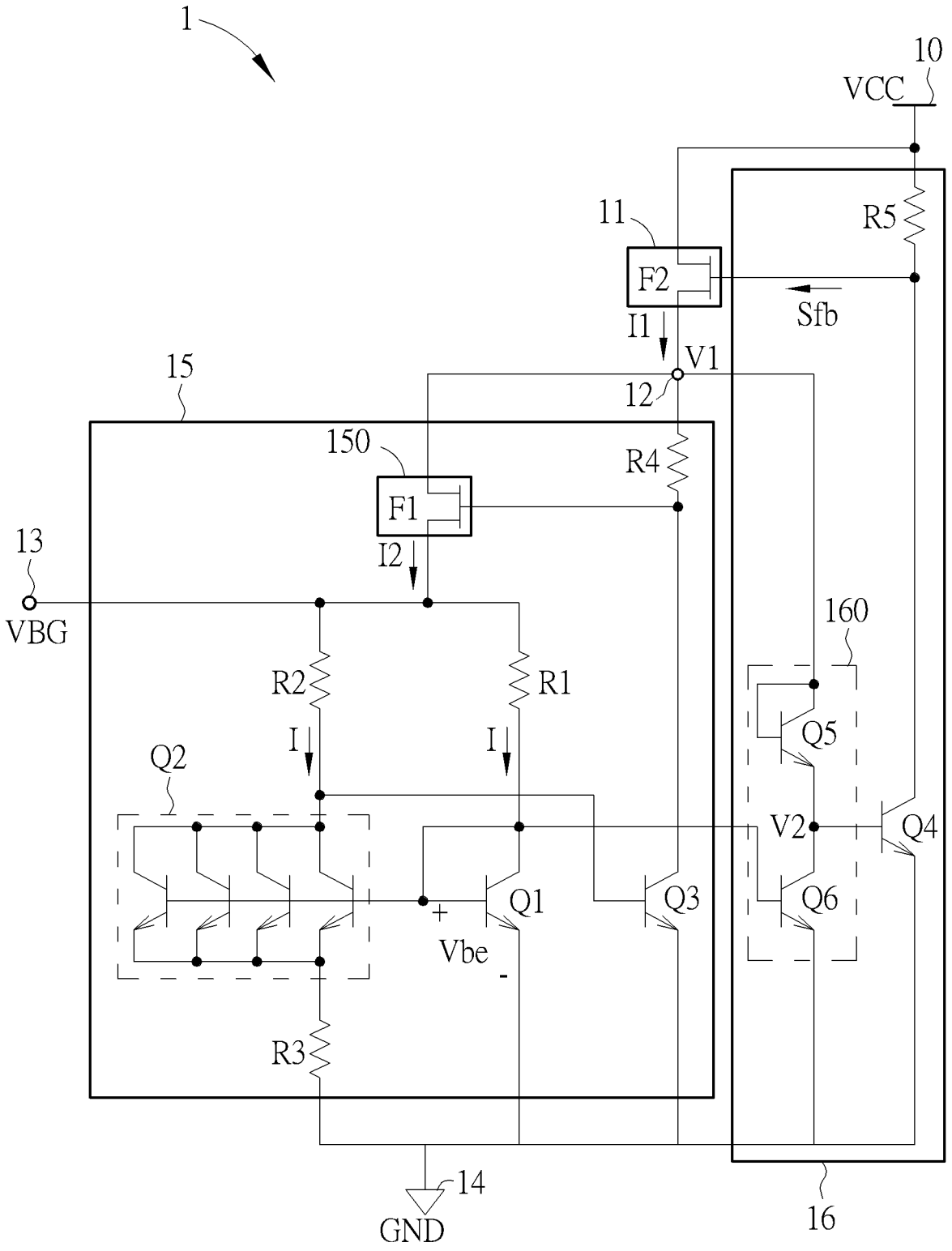
FIG. 2 is a circuit schematic of the reference voltage generation circuit in FIG. 1.

FIG. 2 is a circuit schematic of the reference voltage generation circuit 1 in FIG. 1. The current source 11 includes a transistor F2 including a first terminal coupled to the supply voltage terminal 10, a second terminal coupled to the node 12, and a control terminal coupled to the feedback circuit 16. The current source 11 may be controlled by the feedback signal Sfb to output the current I1, so as to establish at the node 12 the voltage V1 related to the feedback signal Sfb. The bandgap reference circuit 15 includes a current source 150, resistors R1 to R4 and bipolar junction transistors Q1 to Q3. The current source 150 is coupled to the node 12. The current source 150 includes a transistor F1 including a first terminal coupled to the node 12, a second terminal coupled to the output terminal 13, and a control terminal coupled to a second terminal of the resistor R4. The resistor R1 has a first terminal and a second terminal. The first terminal of the resistor R1 is coupled to the output terminal 13. The bipolar junction transistor Q1 has a collector, a base and an emitter. The collector of the bipolar junction transistor Q1 is coupled to the second terminal of the resistor R1 and the base of the bipolar junction transistor Q1, and the emitter of the bipolar junction transistor Q1 is coupled to the common voltage terminal 14. The resistor R2 has a first terminal and a second terminal. The first terminal of the resistor R2 is coupled to the output terminal 13. The bipolar junction transistor Q2 has a collector, a base and an emitter. The collector of the bipolar junction transistor Q2 is coupled to the second terminal of the resistor R2, and the base of the bipolar junction transistor Q2 is coupled to the base of the bipolar junction transistor Q1. The resistor R3 is coupled between the emitter of the bipolar junction transistor Q2 and the common voltage terminal 14. The bipolar junction transistor Q3 has a collector, a base and an emitter. The base of the bipolar junction transistor Q3 is coupled to the collector of the bipolar junction transistor Q2, and the emitter of the bipolar junction transistor Q3 is coupled to the common voltage terminal 14. In another embodiment, the base of the bipolar junction transistor Q3 may also be coupled to the base of the bipolar junction transistor Q2. The resistor R4 has a first terminal and the second terminal. The first terminal of the resistor R4 is coupled to the node 12, and the second terminal of the resistor R4 is coupled to the current source 150 and the collector of the bipolar junction transistor Q3. The feedback circuit 16 is coupled to the node 12 and the current source 11, and includes a bipolar junction transistor Q4 and a resistor R5. The bipolar junction transistor Q4 has a collector, a base, and an emitter. The emitter of the bipolar junction transistor Q4 is coupled to the common voltage terminal 14, and a voltage at the base of the bipolar junction transistor Q4 is controlled by the voltage V2 and/or the voltage V1. The resistor R5 has a first terminal and a second terminal. The first terminal of the resistor R5 is coupled to the supply voltage terminal 10, and the second terminal of the resistor R5 is coupled to the current source 11 and the collector of the bipolar junction transistor Q4. The feedback circuit 16 may further include a level shifter 160. The level shifter 160 is coupled to the node 12, the base of the bipolar junction transistor Q4 and the common voltage terminal 14. The level shifter 160 includes bipolar junction transistors Q5 and Q6. The bipolar junction transistor Q5 is connected in a diode configuration to provide level shifting, and has a collector, a base and an emitter. The collector of the bipolar junction transistor Q5 is coupled to the node 12, and the emitter of bipolar junction transistor Q5 is coupled to the base of the bipolar junction transistor Q4. The bipolar junction transistor Q6 has a collector, a base and an emitter, and may serve as a current sink. The collector of the bipolar junction transistor Q6 is coupled to the emitter of the bipolar junction transistor Q5, and the base of the bipolar junction transistor Q6 is coupled to the base of the bipolar junction transistor Q1, and the emitter of the bipolar junction transistor Q6 is coupled to the common voltage terminal 14.

The current source 11 may generate the current I1 according to the supply voltage VCC, and output the current I1 to establish the voltage V1 at the node 12. The current source 150 may generate the current I2 according to the voltage V1, and output the current I2 to establish at the output terminal 13 the bandgap reference voltage VBG. The transistors F1 and F2 are configured into source followers or emitter followers. The bandgap reference circuit 15 may combine a forward voltage of a PN junction of the bipolar junction transistor Q3 having a negative temperature coefficient and a thermal voltage having a positive temperature coefficient, so as to generate a bandgap reference voltage VBG having substantially zero temperature coefficient. The bipolar junction transistors Q1 and Q2 may be different in cross-sectional areas, and the resistances of the resistors R1 and R2 may be adjustable, thereby keeping the bandgap reference voltage VBG substantially constant. The feedback circuit 16 may provide a feedback loop for the current source 11 to stabilize the voltage V1. In the feedback circuit 16, the level shifter 160 may convert the voltage V1 into the voltage V2 at the base of the bipolar junction transistor Q4, the bipolar junction transistor Q4 and the resistor R5 may form a feedback amplifier and provide the feedback signal Sfb, wherein the feedback signal Sfb is controlled by the voltage V2 at the base of the bipolar junction transistor Q4. In the feedback loop, the bipolar junction transistor Q6 may provide a bias to the bipolar junction transistor Q5 in the level shifter 160, the bipolar junction transistor Q5 forms a diode to down-convert the voltage V1 into the ($V1-V_{BE}$) to serve as the voltage V2 at the base of the bipolar junction transistor Q4, $V_{BE}$ being a base-emitter voltage of the diode. The voltage V2 at the base of the bipolar junction transistor Q4 controls a collector current of the bipolar junction transistor Q4, and the collector current flows through the resistor R5 to generate the feedback signal Sfb, and the current source 11 may receive the feedback signal Sfb so as to control the voltage V1.

When the supply voltage VCC increases, the voltage V1 may increase accordingly. The bipolar junction transistor Q5 may increase the voltage V2 according to the increased voltage V1, and in turn, the collector current of the bipolar junction transistor Q4 may increase accordingly, the increased collector current may flow through the resistor R5 to reduce the voltage of the feedback signal Sfb, and the current source 11 may receive the reduced voltage of the feedback signal Sfb to suppress the voltage V1, thereby generating the voltage V1 substantially insensitive to the variations of the supply voltage VCC. Conversely, when the supply voltage VCC decreases, the voltage V1 may decrease accordingly. The bipolar junction transistor Q5 may decrease the voltage V2 according to the decreased voltage V1, and in turn, the collector current of the bipolar junction transistor Q4 may decrease accordingly, the decreased collector current may flow through the resistor R5 to increase the voltage of the feedback signal Sfb, and the current source 11 may receive the increased voltage of the feedback signal Sfb to increase the voltage V1, generating the voltage V1 substantially insensitive to the variations of the supply voltage VCC, and enabling the reference voltage generation circuit 1 to generate at the output terminal 13 the bandgap reference voltage VBG substantially insensitive to the variations of the supply voltage VCC. In the embodiments, by employing the feedback control of the current source 11 and the feedback circuit 16, the variations of the voltage V1 and the bandgap reference voltage VBG may be controlled within ±3% regardless of the variation of the supply voltage VCC. For example, as the supply voltage VCC varies in a range between 3.5V and 5.5V, the variation of the voltage V1 may be kept between 1.74V and 1.75V, allowing variation rates of the voltage V1 and the bandgap reference voltage VBG to be kept within ±0.5% regardless of the variation of the supply voltage VCC. In comparison to other circuit designs without employing the current source 11 and the feedback circuit 16, in other words, providing the supply voltage VCC directly to the current source 150 and the first terminal of the resistor R4 of the bandgap reference circuit 15, the circuit designs without the current source 11 and the feedback circuit 16 may result in a considerable increase of the variation rate of the bandgap reference voltage VBG by 7% as the supply voltage VCC varies.

All the bipolar junction transistors Q1 to Q6 may include NPN heterojunction bipolar transistors (HBT). All the bipolar junction transistors may be NPN-type bipolar junction transistors. Both the transistors F1 and F2 may include bipolar junction transistors or field effect transistors, and specifically, NPN-type bipolar junction transistors, N-type metal semiconductor field effect transistors (MESFET) or pseudomorphic high electron mobility transistors (pHEMT).

The reference voltage generation circuits 1 in FIGS. 1 and 2 may provide a stable bandgap reference voltage VBG substantially invariant with the variations of the temperature and supply voltage, having low power consumption, and being fabricatable using bipolar junction transistor, complementary metal oxide semiconductor, bipolar-complementary metal-oxide-semiconductor (BiCMOS), or bipolar high electron mobility transistor (BiHEMT) technologies.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A reference voltage generation circuit for generating a bandgap reference voltage, the reference voltage generation circuit comprising:

a supply voltage terminal, configured to provide a supply voltage;

a node;

a first current source, coupled between the supply voltage terminal and the node, and configured to generate a first current according to the supply voltage, and output the first current to establish a first voltage at the node;

an output terminal;

a common voltage terminal, configured to provide a common voltage;

a bandgap reference circuit, coupled between the node and the common voltage terminal, configured to establish the bandgap reference voltage at the output terminal, and comprising:

a second current source, coupled to the node, and configured to generate a second current to establish the bandgap reference voltage at the output terminal;

a first resistor, having a first terminal and a second terminal, the first terminal of the first resistor being coupled to the output terminal;

a first bipolar junction transistor, having a collector, a base, and an emitter, wherein the collector of the first bipolar junction transistor is coupled to the second terminal of the first resistor and the base of the first bipolar junction transistor, and the emitter of the first bipolar junction transistor is coupled to the common voltage terminal;

a second resistor, having a first terminal and a second terminal, the first terminal of the second resistor being coupled to the output terminal;

a second bipolar junction transistor, having a collector coupled to the second terminal of the second resistor, a base coupled to the base of the first bipolar junction transistor, and an emitter;

a third resistor, coupled between the emitter of the second bipolar junction transistor and the common voltage terminal;

a third bipolar junction transistor, having a collector, a base coupled to the collector or the base of the second bipolar junction transistor, and an emitter coupled to the common voltage terminal; and a fourth resistor, having a first terminal and a second terminal, the first terminal of the fourth resistor being coupled to the node, and the second terminal of the fourth resistor being coupled to the second current source and the collector of the third bipolar junction transistor; and a feedback circuit, coupled to the node and the first current source, configured to stabilize the first voltage, and comprising:

a fourth bipolar junction transistor, having a collector, a base, and an emitter coupled to the common voltage terminal, a voltage at the base of the fourth bipolar junction transistor being controlled by the first voltage; and a fifth resistor, having a first terminal coupled to the supply voltage terminal and a second terminal coupled to the first current source and the collector of the fourth bipolar junction transistor.

2. The reference voltage generation circuit of claim 1, wherein the feedback circuit further comprises:

a level shifter, coupled to the node, the base of the fourth bipolar junction transistor and the common voltage terminal, and configured to convert the first voltage into a voltage at the base of the fourth bipolar junction transistor.

3. The reference voltage generation circuit of claim 2, wherein the level shifter comprises:

a fifth bipolar junction transistor, arranged into a diode configuration, having a collector coupled to the node, a base, and an emitter coupled to the base of the fourth bipolar junction transistor.

4. The reference voltage generation circuit of claim 3, wherein the level shifter further comprises:

a sixth bipolar junction transistor, having a collector coupled to the emitter of the fifth bipolar junction transistor, a base coupled to the base of the first bipolar junction transistor, and an emitter coupled to the common voltage terminal.

5. The reference voltage generation circuit of claim 4, wherein the first to the sixth bipolar junction transistors are NPN bipolar junction transistors.

6. The reference voltage generation circuit of claim 1, wherein the first to the fourth bipolar junction transistors, and the first current source and the second current source are NPN heterojunction bipolar transistors (HBT).

7. The reference voltage generation circuit of claim 1, wherein:

the first current source comprises a first transistor having a first terminal coupled to the supply voltage terminal, a second terminal coupled to the node, and a control terminal coupled to the feedback circuit; and the second current source comprises a second transistor having a first terminal coupled to the node, a second terminal coupled to the output terminal, and a control terminal coupled to the second terminal of the fourth resistor.

8. The reference voltage generation circuit of claim 1, wherein the first bipolar junction transistor and the second bipolar junction transistor are different in cross-sectional areas.

9. A reference voltage generation circuit for generating a bandgap reference voltage, the reference voltage generation circuit comprising:

a supply voltage terminal, configured to provide a supply voltage;

a node;

a first current source, coupled between the supply voltage terminal and the node, and configured to receive the supply voltage and generate a first current according to a feedback signal, and output the first current to establish a first voltage at the node substantially insensitive to variations of the supply voltage;

an output terminal;

a common voltage terminal, configured to provide a common voltage;

a bandgap reference circuit, coupled to the node and the common voltage terminal, configured to establish at the output terminal the bandgap reference voltage substantially insensitive to variations of temperature; and a feedback circuit, coupled between the node and the first current source, configured to generate the feedback signal according to the first voltage, and comprising:

a fourth bipolar junction transistor, having a collector, a base, and an emitter coupled to the common voltage terminal, a voltage at the base of the fourth bipolar junction transistor is controlled by the first voltage; and a fifth resistor, having a first terminal coupled to the supply voltage terminal and a second terminal coupled to the first current source and the collector of the fourth bipolar junction transistor to provide the feedback signal, wherein the feedback signal is controlled by a voltage at the base of the fourth bipolar junction transistor;

wherein a variation trend of the first voltage is related to a variation trend of the feedback signal.

10. The reference voltage generation circuit of claim 9, wherein the bandgap reference circuit comprises:

a second current source, coupled to the node, and configured to generate a second current to establish the bandgap reference voltage at the output terminal;

a first resistor, having a first terminal and a second terminal, the first terminal of the first resistor being coupled to the output terminal;

a first bipolar junction transistor, having a collector, a base, and an emitter, wherein the collector is coupled to the second terminal of the first resistor and the base of the first bipolar junction transistor, and the emitter of the first bipolar junction transistor is coupled to the common voltage terminal;

a second resistor, having a first terminal and a second terminal, the first terminal of the second resistor being coupled to the output terminal;

a second bipolar junction transistor, having a collector coupled to the second terminal of the second resistor, a base coupled to the base of the first bipolar junction transistor, and an emitter;

a third resistor, coupled between the emitter of the second bipolar junction transistor and the common voltage terminal;

a third bipolar junction transistor, having a collector, a base coupled to the base of the second bipolar junction transistor, and an emitter coupled to the common voltage terminal;

a fourth resistor, having a first terminal and a second terminal, the first terminal of the fourth resistor being coupled to the node, and the second terminal of the fourth resistor being coupled to the second current source and the collector of the third bipolar junction transistor.

11. The reference voltage generation circuit of claim 9, wherein the first to the fourth bipolar junction transistors, and the first current source and the second current source are NPN heterojunction bipolar transistors (HBT).

12. The reference voltage generation circuit of claim 10, wherein:

the first current source comprises a first transistor having a first terminal coupled to the supply voltage terminal, a second terminal coupled to the node, and a control terminal coupled to the feedback circuit; and the second current source comprises a second transistor having a first terminal coupled to the node, a second terminal coupled to the output terminal, and a control terminal coupled to the second terminal of the fourth resistor.

13. The reference voltage generation circuit of claim 12, wherein the first transistor and the second transistor both comprise bipolar junction transistors, field effect transistors, NPN-type bipolar junction transistors, N-type metal semiconductor field effect transistors (MESFET) or pseudomorphic high electron mobility transistors (pHEMT).

14. The reference voltage generation circuit of claim 10, wherein the first bipolar junction transistor and the second bipolar junction transistor are different in cross-sectional areas.

15. The reference voltage generation circuit of claim 9, wherein the variation trend of the first voltage is opposite to the variation trend of the feedback signal.

* * * * *